US005838641A

United States Patent [19]

Tohkoku et al.

[11] Patent Number: 5,838,641

[45] Date of Patent: Nov. 17, 1998

[54] MECHANICAL TIMEPIECE WITH TOURBILLON MECHANISM

[75] Inventors: Muneo Tohkoku; Tsuyoshi Tanaka, both of Chiba, Japan

[73] Assignee: Seiko Instruments Inc., Japan

[21] Appl. No.: 860,851

[22] PCT Filed: Aug. 9, 1996

[86] PCT No.: PCT/JP96/02266

§ 371 Date: Sep. 15, 1997

§ 102(e) Date: Sep. 15, 1997

[87] PCT Pub. No.: WO97/07435

PCT Pub. Date: Feb. 27, 1997

[30] Foreign Application Priority Data

Aug. 18, 1995 [JP] Japan ..... 7-210784

[51] Int. Cl.[6] ..... G04B 15/00; G04B 19/20

[52] U.S. Cl. ..... 368/127; 368/142

[58] Field of Search ..... 368/76, 77, 124–128, 368/139, 144

[56] References Cited

U.S. PATENT DOCUMENTS 5,608,694 3/1997 Grimm et al. ..... 368/127

*Primary Examiner*—Vit W. Miska
*Attorney, Agent, or Firm*—Adams & Wilks

[57] ABSTRACT

A mechanical timepiece comprises a tourbillon mechanism having a housing mounted for rotation about a rotational axis, an escape wheel mounted in the housing for rotation, a balance wheel mounted in the housing for undergoing rotational vibration, and a pallet-fork for transmitting the rotational force of the escape wheel to the balance wheel. The housing has a first plate, a second plate and connecting members for connecting the first and second plates in spaced-apart relation. The second plate has a gear formed on an outer peripheral surface thereof. A drive train is connected to the gear of the second plate of the housing for rotationally driving the housing.

20 Claims, 7 Drawing Sheets

MECHANICAL TIMEPIECE WITH TOURBILLON MECHANISM

TECHNICAL FIELD

The present invention pertains to a a mechanical timepiece with a tourbillon mechanism which is thin-shaped and which can facilitate an adjusting operation during assembly.

BACKGROUND ART

In an ordinary mechanical timepiece that uses a main spring as the power source, uses as the controller a timed annular balance having a hair spring mounted thereon and uses a pallet fork and escape wheel as the escapement, there occurs the dynamic eccentricity error of the center of gravity due to the inevitable non-uniformity of the configuration of the timed annular balance. Also, during the operation, shifting of the center of gravity occurs due to the expansion and contraction of the hair spring. For this reason, it results that where the timepiece vertical attitude, the isochronism of the timed annular balance fluctuates depending on what time position is located upside. As a mechanism for canceling the above-mentioned fluctuation of the isochronism due to the attitude of the timepiece, there is a mechanism which is called "tourbillon".

The tourbillon mechanism is one which was developed by the French A. L. Brequet about 200 years ago for the purpose of causing an increase in the time accuracy of portable timepieces. The tourbillon mechanism is basically arranged to have the escapement and controller loaded on a final stage gear of the speed-up gear train to thereby construct a cage and arranged, by causing this cage itself to rotate at all times, to cancel the fluctuation in isochronism that occurs due to the attitude of the timepiece.

Also, on account of its minute structure, the tourbillon mechanism has its cage portion exposed on a dial side of the timepiece and has its parts elaborately finished to thereby appeal its mysterious movements, thereby also aiming to enhance the commercial value of timepieces with the tourbillon mechanism as that in a region of complex timepiece. One of the reasons for this is because the tourbillon mechanism has in itself the power of appealing its unique technological beauty.

FIG. 8 is a sectional view illustrating a timepiece that uses a conventional tourbillon mechanism. The power of a main spring not illustrated is transmitted to a gear 30 at a terminal end of the speed-up gear train. The rotation of the gear 30 at this terminal end thereof is transmitted to a pinion 31 (pinion) that has been provided at a lower end of a cage 29, whereby the cage 29 is rotated. In this cage 29, there are loaded between a cage upper plate 12 and a cage lower plate 32 an escape wheel 5, a pallet fork 6 that is engaged with the escape wheel 5 and a timed annular balance that is engaged with the pallel fork 6. The cage upper plate 12 and the cage lower plate 32 are connected to each other by cage support columns 11. With a shaft pin 13 provided on the cage upper plate 12 and a shaft pin 33 provided on the cage lower plate 32 being used as the rotating shafts, the cage 29 is rotated. An escape pinion 3 that has been formed coaxially with the escape wheel 5 is meshed with a sun gear 19 that is fixed to a main plate 8. When the cage 29 is rotated, the escape pinion 3 makes a planetary gear movement of its revolving around the sun gear 19 while rotating about its own axis. By this planetary gearing, the rotation of the speed-up gear train is transmitted to the escape wheel 5. The rotating force of the escape wheel 5 is transmitted to the timed annular balance 7 through the pallet fork 6 and thereby serves as a power source for causing rotational vibration of the timed annular balance 7.

Since as mentioned above by the cage 29 being rotated the escape wheel 5, pallet fork 6 and timed annular balance 7 loaded inside the cage 29 are integrally rotated at all times, the fluctuations in isochronism that occur when the timepiece is at four vertical attitudes wherein 12 o'clock, 3 o'clock, 6 o'clock and 9 o'clock are located upside are canceled one another, with the result that the isochronism becomes always fixed.

However, in the above-mentioned tourbillon mechanism, since the cage pinion 31 for rotating the cage is located at the lowermost end of the cage 29, the cage pinion 31 is superposed on the thickness of the main body of the cage 29, with the result that the thickness of the mechanical body of the timepiece increases.

Also, the adjustment of time accuracy is performed by, as in the case of an ordinary mechanical timepiece, suitably adjusting at the regulator position the effective length of the hair spring 4 provided to the timed annular balance, which affects the isochronism, or suitably adjusting the stud support position, i.e. the support portion of the hair spring 4, which affects the balanced state of the rotation vibration of the timed annular balance. However, since the regulator and the stud support are rotated jointly with the cage 29, it is impossible to perform the adjustment of time accuracy when the timepiece is in an ordinary state of operation. For this reason, there is prepared a special jig that enables the adjusting operation to be performed with the cage 29 being kept fixed. However, in the case of a gear with a circular arc tooth profile that is employed in the conventional mechanical timepiece, when the mating gear with which the gear is to be meshed is replaced, the torque transmission characteristic thereof is inconveniently changed. Accordingly, in the case of the tourbillon mechanism, the driven state that stands during the ordinary operation and the driven state that stands during the adjusting operation naturally differ from each other, with the result that the precise time adjustment is difficult to perform.

Accordingly, the object of the present invention is to provide a mechanical timepiece with a tourbillon mechanism, which is thin-shaped, large in freedom in design and can afford precise adjustment of time accuracy.

SUMMARY OF THE INVENTION

In order to attain the above object, according to the present invention, by adopting a method wherein the rotating force from the speed-up gear train is received by a gear provided on the outer periphery of the cage lower plate, the use of the cage pinion has been made unnecessary. Also, by adopting a method wherein an internal tooth gear is used in place of the sun gear that constitutes the planetary gearing, the disposition of the cage as viewed from above has been made larger in freedom. Further, by adopting a method wherein the tooth profile of the gears associated with the transmission of the rotating force from the speed-up gear train to the cage is formed by an involute of the same module and the same pressure angle, there has been made more precise the adjustment of time accuracy that is made with respect to the tourbillon mechanism by the use of a time accuracy adjusting jig that has driving gears that have been formed with the same involute tooth profile.

DETAILED DESCRIPTION OF THE PREFERRED EMBODIMENT

In the present invention, as an embodiment that stands on the adoption of the above-mentioned methods, in a mechanical timepiece with a tourbillon mechanism that has a cage that has loaded thereon a timed annular balance, pallet fork and escape wheel and that is rotated integrally therewith, this cage is made to have a cage lower plate that is formed, on an outer periphery thereof, with a gear that is driven by a gear train to thereby make it possible to realize a very thin movement.

Also, by it being arranged that an escape pinion that has been formed coaxially with the escape wheel is meshed with an internal tooth gear that has been fixed to a main plate, bridge or the like, whereby the escape pinion and the internal tooth gear make a planetary gear movement of, as the cage is rotated, the escape wheel revolving while rotating about its own axis, it is possible to realize a mechanism that is interesting when viewed with the naked eyes.

By the cage having a cage upper plate that is equipped with a pallet bridge that swingably supports a pallet fork and by the pallet bridge being made not to overlap, when viewed from above, a rim portion of the timed annular balance pivotally supported by a cage lower plate and the cage upper plate, it is possible to realize further thinning of the timepiece.

And, by the tooth profile of at least the gear formed on the outer periphery of the cage lower plate, the internal tooth gear and the escape pinion being formed by an involute of the same module and the same pressure angle, the adjustment of time accuracy can be made precise.

An embodiment of the present invention will now be explained with reference to the drawings.

Figure 1:
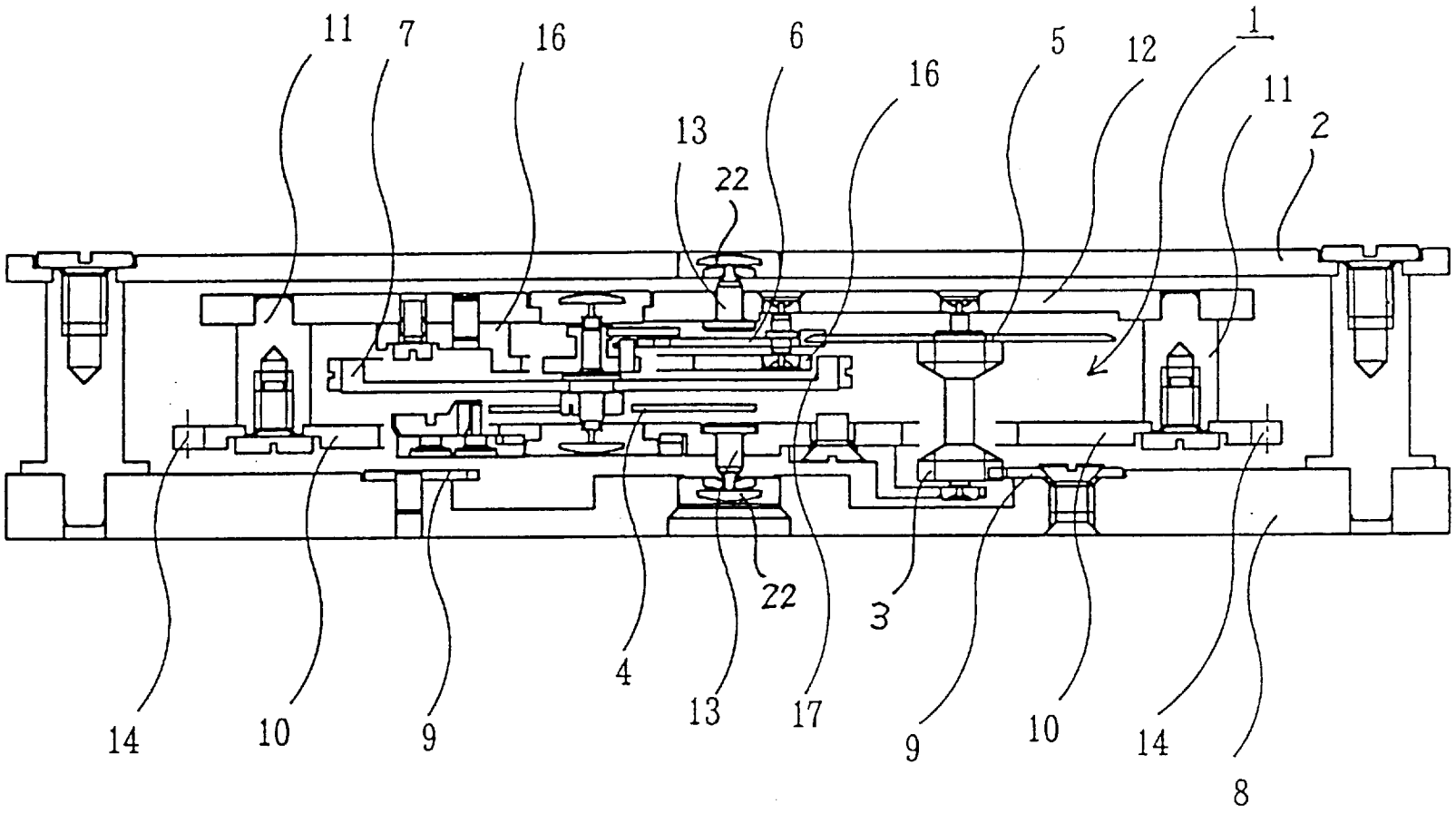
FIG. 1 is a sectional view illustrating an embodiment of a cage portion of a tourbillon mechanism that is used in a mechanical timepiece according to the present invention.

FIG. 1 is a sectional view illustrating a housing or cage 1 which is a main part of the mechanical timepiece with a tourbillon mechanism according to the present invention. A main part of the cage 1 is constructed between a cage lower plate 10 and a cage upper plate 12. The cage lower plate 10 is formed, on an outer periphery thereof, with a gear 14 and is connected to the cage upper plate 12 by two support columns 11. The cage lower plate 10 and the cage upper plate 12 have, respectively, a pair of shaft pins 13 one of which is pointed downward and the other of which is pointed upward, whereby the cage 1 is shaped like a bird cage that can be rotated about this pair of shaft pins 13. The shaft pins 13 are supported by bearings 22 that are provided respectively in a main plate 8 and a bridge 2. And, in the interior of this cage 1, there are stored an escapement and a controller which are a main part of the timepiece, i.e. an escape wheel 5, a pallet fork 6 and a balance wheel or timed annular balance 7.

While these parts are substantially the same as the escapement and the controller of an ordinary mechanical timepiece, in this embodiment a pinion 3 escape (pinion) of the escape wheel 5 that is made to rotate about its own axis is made to protrude outward from the cage lower plate 10 in parallel with the shaft pin 13 of the cage 1. This escape pinion 3 is meshed with a circular annulus-shaped internal tooth gear 9 that has been disposed and fixed on the main plate 8 concentrically with the shaft pin 13 and, as the cage 1 is rotated, the escape pinion 3 revolves while rotating about its own axis. Namely, the escape pinion 3 and the internal tooth gear 9 form a planetary gearing.

Figure 2:
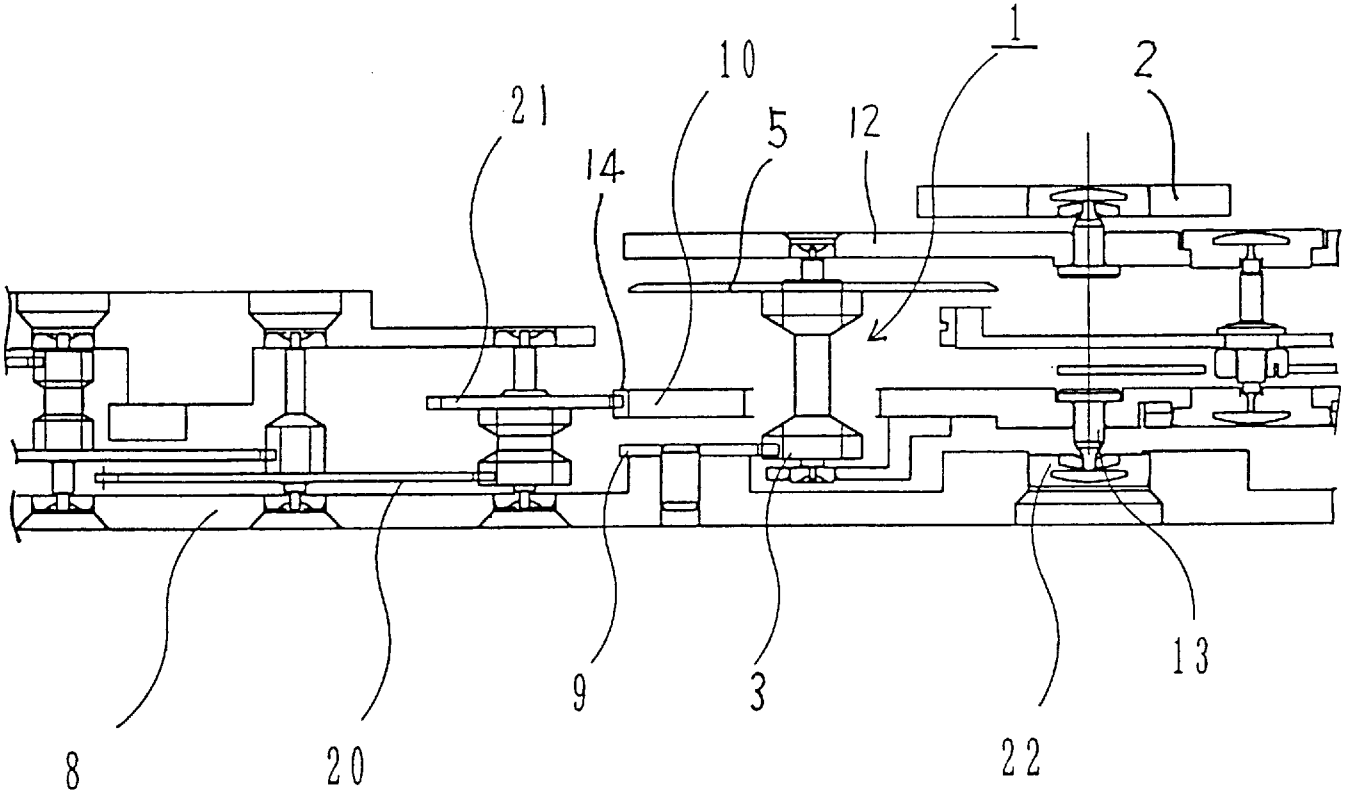
FIG. 2 is a sectional view illustrating an engagement relationship between the cage portion and a gear train of the tourbillon mechanism that is used in the mechanical timepiece according to the present invention.
Figure 4:
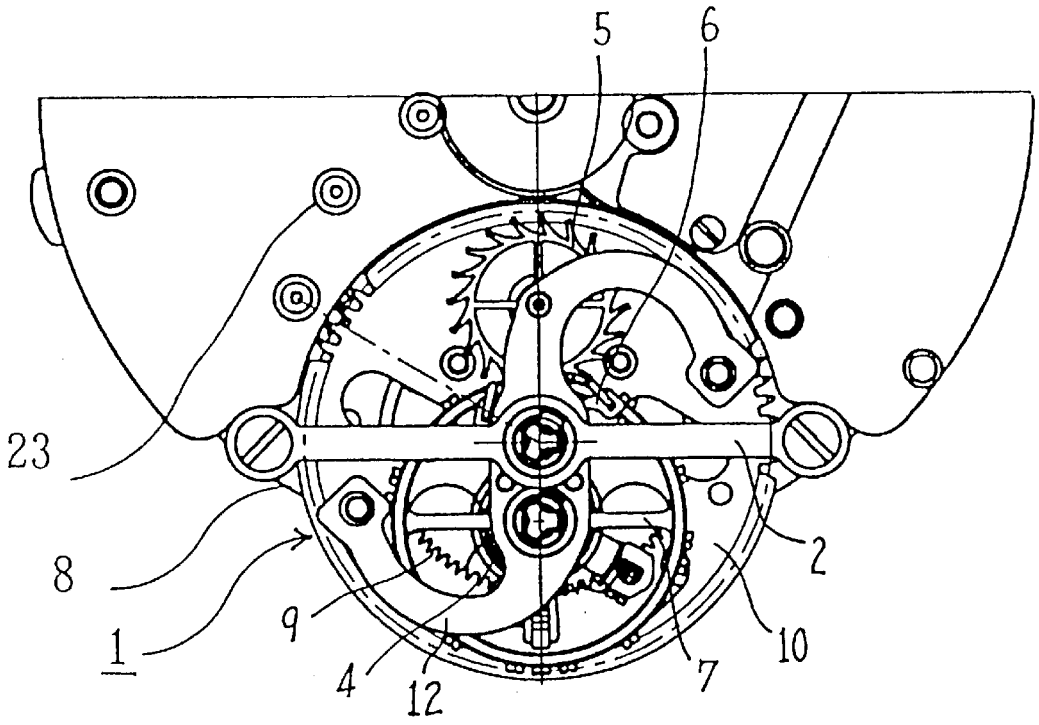
FIG. 4 is a plan view illustrating the embodiment of the cage portion of the tourbillon mechanism that is used in the mechanical timepiece according to the present invention.

FIG. 2 illustrates a state of the rotating force being transmitted to the cage 1. The power of a main spring not illustrated is transmitted to a fifth gear 21 through a fourth gear 20 of a speed-up gear train. The fifth gear 21 is meshed with the gear 14 that has been formed on the outer periphery of the cage lower plate 10 and, as this fifth gear 21 is rotated, the entire cage 1 is rotated. As the cage 1 is rotated, the escape pinion 3 that is meshed with the internal tooth gear 9 is rotated with the result that the rotating force is transmitted to the escape wheel 5. As illustrated in a plan view of FIG. 4, the rotating force of the escape wheel 5 is transmitted intermittently to the pallet fork 6 that constitutes the escapement along with the escape wheel 5, whereby the pallet fork 6 is intermittently swung. By the intermittent swinging of the pallet fork 6, the resulting driving force is intermittently applied to the timed annular balance 7. As a result, the timed annular balance 7 that serves as the controller continues to make an isochronic rotational vibration by the elastic force of a hair spring 4.

Figure 8:
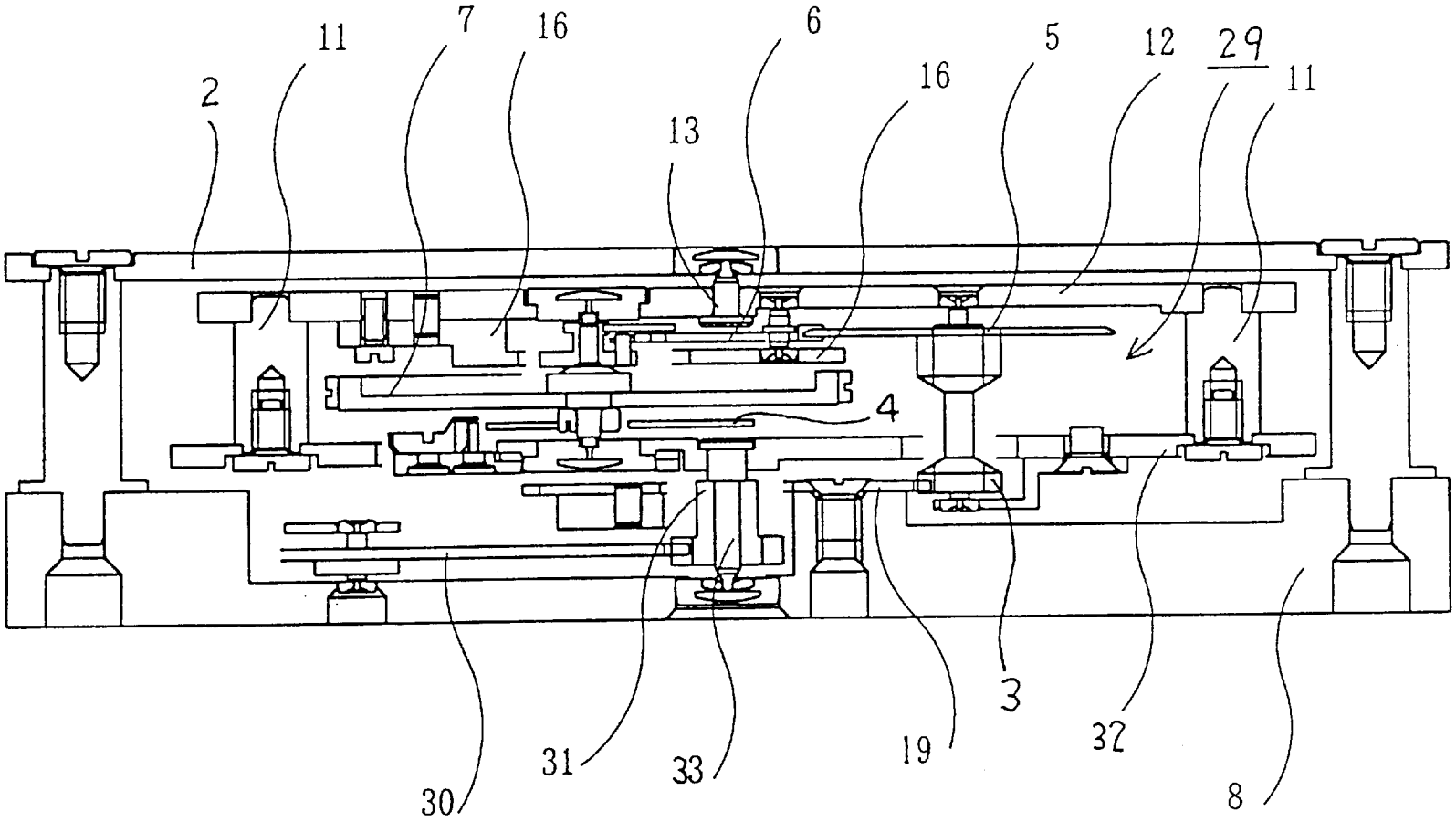
FIG. 8 is a sectional view illustrating a cage portion and its vicinity of a mechanical timepiece that is equipped with a conventional tourbillon mechanism.

As mentioned above, in the construction of the present invention, since it has been structured that the outer periphery of the cage lower plate 10 is formed thereon with the gear 14 and this gear 14 receives the rotating force of the speed-up gear train, the use of the cage pinion 31 in the conventional timepiece shown in FIG. 8 which was the cause of increasing the thickness of the mechanical body becomes unnecessary. For this reason, despite the timepiece being equipped with a complex mechanism referred to as the tourbillon mechanism, a very thin movement has become able to be constructed.

Also, since the internal tooth gear 9 that constitutes the planetary gearing along with the escape pinion 3 is not an external tooth gear which was so in the prior art but has been constituted by an internal tooth gear, the position for fixing this internal tooth gear 9 can be shifted to the side of the outer periphery thereof. Namely, since some spatial allowance can be made around the bearing 22 for supporting the shaft pin 13 of the cage 1, the freedom in design is increased with the result that the design with some freedom in reserve that stands on the consideration of the thinning of the timepiece has become possible.

Also, as illustrated in FIG. 1, the pallet bridge 16 for supporting the swinging movement of the pallet fork 6 is secured to the inside of the cage upper plate 12. While FIG.

6 is a plan view that has been taken of the cage upper plate 12 from the side of the pallel bridge 16, it has been arranged that the configuration of this pallet bridge 16 is disposed inside a rim 17 of the timed annular balance 7 in rotational vibration with a clearance A being provided therebetween. As a result of this, since the overlapping of the pallet bridge 16 upon the timed annular balance 7 that might occur when both are viewed from above can be avoided, it has become possible to make the cage 1 thinner. Further, since this disposition/ construction makes the level difference between the timed annular balance 7 and the escape wheel 5 small, in a case where it has been arranged that the tourbillon mechanism can be visually recognized from a hole that has been provided in the dial of the timepiece, it becomes possible to visually definitely recognize the timed annular balance 7 and the escape wheel 5 which make their featuring motions. Thus, it is possible to further enhance the commercial value as that of a complex timepiece.

While in the present invention the tooth profile formed by an involute is adopted with respect to the main gears and pinion, the reason for this will now be explained.

Since the entire controller is rotated at all times, when the timepiece is in operation, the regulator and the stud support of the tourbillon mechanism cannot be manipulated. For this reason, when adjusting time accuracy, it is needed to prepare a special jig for directly driving the escape pinion 3 with the cage 1 being kept fixed. By the driven state of the tourbillon mechanism being at this time made the same between during the ordinary operation and during the time accuracy adjusting operation, it is possible to accurately understand, for example, the tendency of unevenness that stands when the timed annular balance 7 swings.

Figure 3:
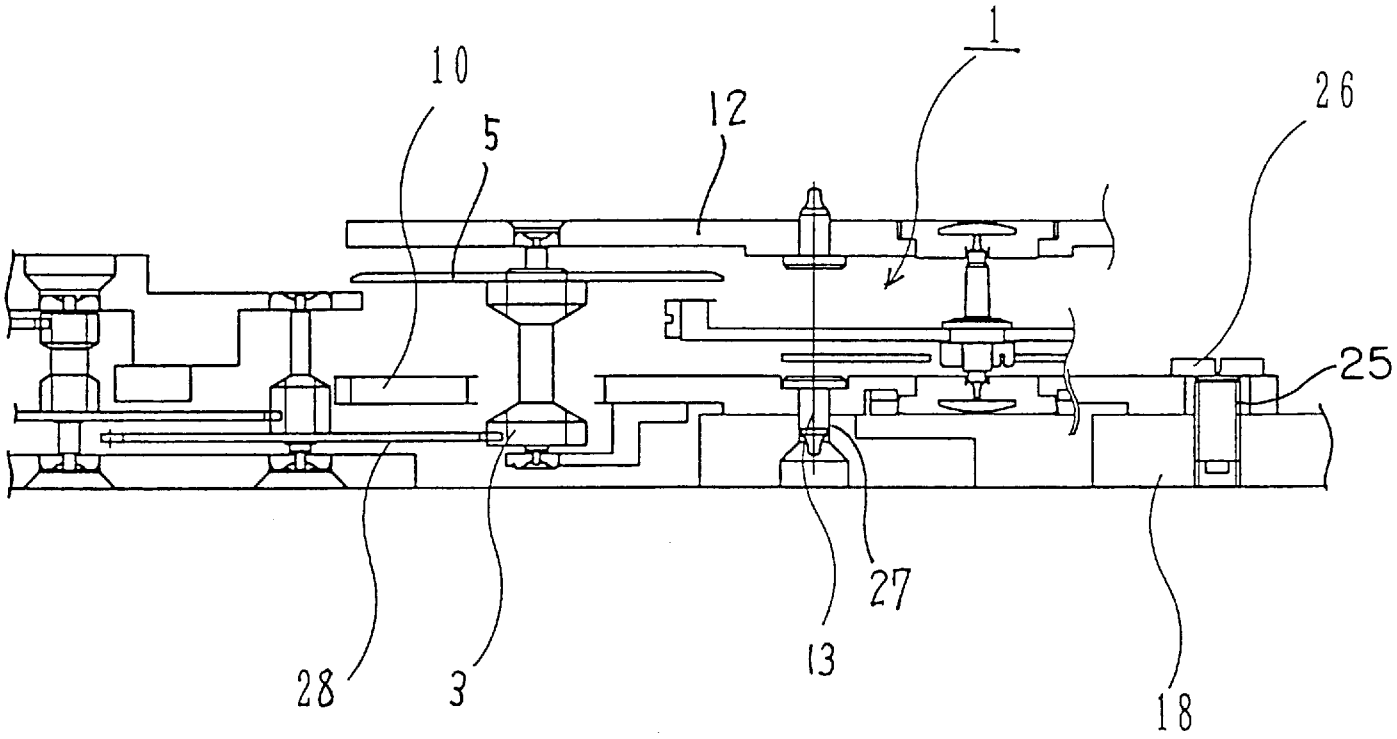
FIG. 3 is a sectional view illustrating a state where there is mounted on an adjusting jig the cage portion of the tourbillon mechanism that is used in the mechanical timepiece according to the present invention.
Figure 5:
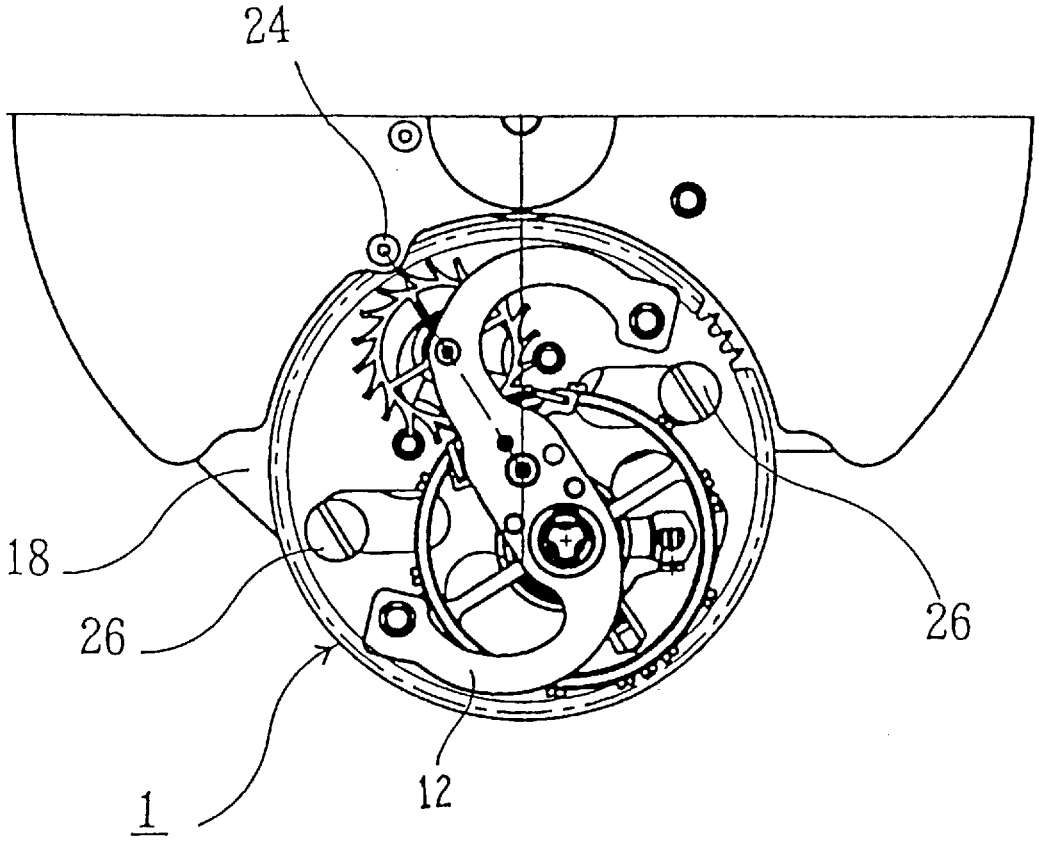
FIG. 5 is a plan view illustrating a state where there is mounted on the adjusting jig the cage portion of the tourbillon mechanism that is used in the mechanical timepiece according to the present invention.
Figure 6:
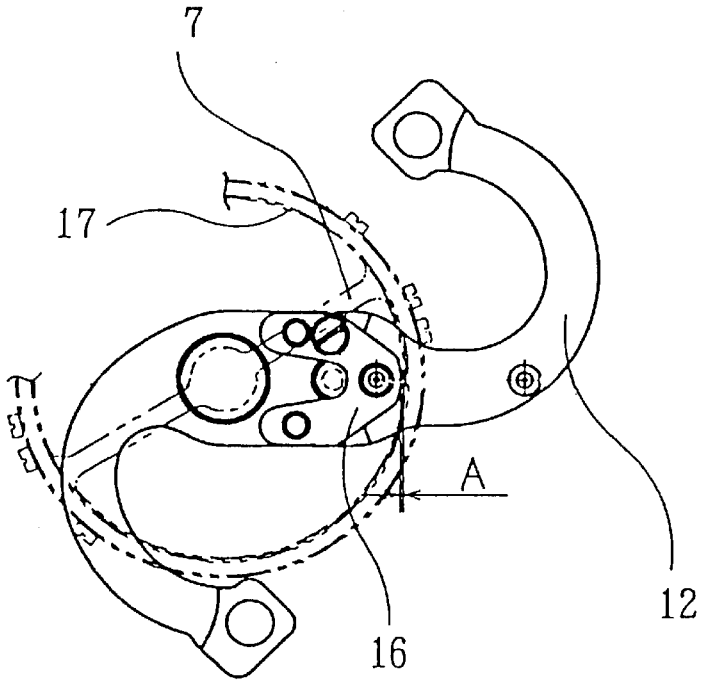
FIG. 6 is a plan view illustrating a positional relationship between a rim of a timed annular balance and a pallet bridge that are used in the mechanical timepiece according to the present invention.

FIG. 3 is a sectional view illustrating a state of the cage 1 being fixed to the adjusting jig, and FIG. 5 is a plan view thereof. The cage 1 is fixed to the main plate 18 by means of two fixing screws 26. The shaft pin 13 on the lower side is inserted into a guide hole 27 that has been provided in the main plate 18, thereby positioning the cage 1. The moving power of the main spring not illustrated that has been provided on the adjusting jig is transmitted to a driving gear 28 through the speed-up gear train. The driving gear 28 is meshed with the escape pinion 3 to thereby drive the escapement and the controller. In this driven state thereof, the adjusting operation for adjusting time accuracy is performed. In this case, the rotation center 24 of the driving gear 28 that has been illustrated in FIG. 5 is provided at a position of the driving gear 28 being directly meshed with the pinion of the escape wheel 5 unlike the rotation center 23 of the fourth gear 20 in the state of ordinary operation illustrated in FIG. 4.

In this construction, the gear train structure that covers from the speed-up gear train to the driving gear 28 is made the same as the gear train structure that covers from the speed-up gear train to the fourth gear 20 in the state of ordinary operation illustrated in FIG. 2. The tooth profiles of the driving gear 28, the escape pinion 3, the fourth gear 20, the fifth pinion, the fifth gear 21, the gear 14 of the cage lower plate and the internal tooth gear 9 have all been formed by an involute of the same module and the same pressure angle. As a result of this, even when the mating gear with which the escape pinion 3 is to be meshed has become different between in the state of the ordinary operation and in the state of the time accuracy adjustment, and even when the manner of intermeshing has somewhat changed between the both, it is possible to fix the transmission characteristic of the rotating torque. Accordingly, the tourbillon mechanism wherein the time accuracy has been adjusted by the adjusting jig can guarantee the time accuracy in the state of the ordinary operation.

Figure 7:
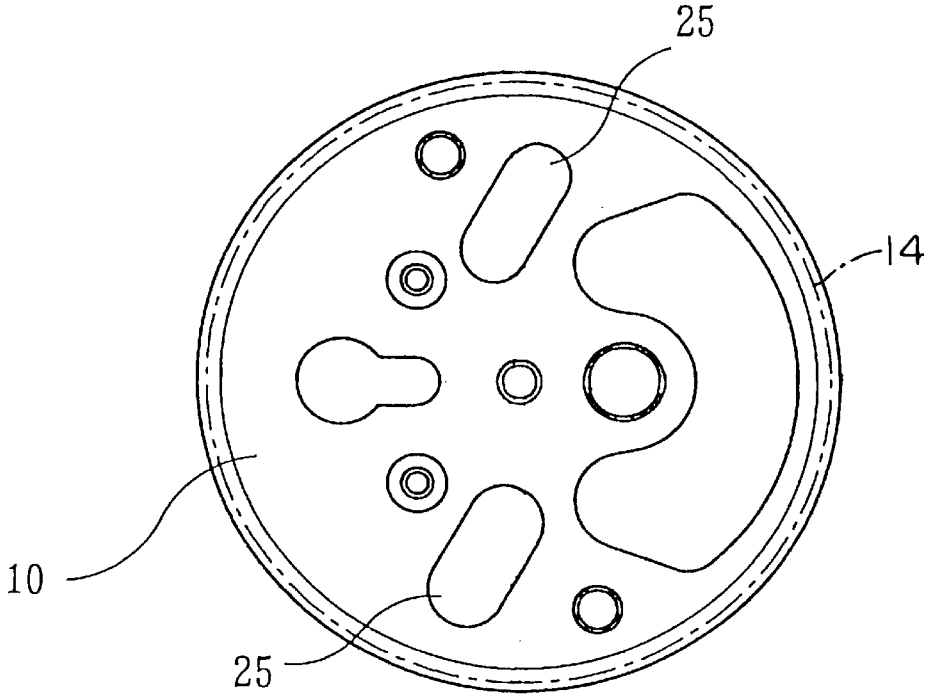
FIG. 7 is a plan view illustrating a representative example of a cage lower plate that is used in the mechanical timepiece according to the present invention.

Also, since as the gear train of the adjusting jig there can be used the same gear train as that which is used at a time of the ordinary operation, there is no need to separately design and manufacture the gear train for use in the adjusting jig. Further, since as illustrated in FIG. 7 it has been arranged that two or more holes 25 are formed in the cage lower plate 10 in advance and the adjusting jig is fixed to the main plate 18 by means of the screws 26, the use of a fixing claw or the like becomes unnecessary and in addition a simple commercially available base product has also become usable as a mechanical base for use in the adjusting jig. Of course, this hole 25 is not limited to an elongate hole such as that illustrated in FIG. 7 and may be a simple hole.

INDUSTRIAL APPLICABILITY

Since in the mechanical timepiece with the tourbillon mechanism according to the present invention the use of the cage pinion has been made unnecessary by it being arranged that the transmission of the rotating force to the cage rotating along with the escapement and the controller is made through the gear that has been provided on the outer periphery of the cage lower plate, it has become possible to construct the very thin movement despite this very thin movement being equipped with a complex mechanism of the tourbillon mechanism. Also, since by the sun gear that constitutes the planetary gearing having been replaced by the internal tooth gear the spatial allowance can be had around the bearing that supports the cage, the disposition of the cage as viewed from above has increased in freedom, with the result that the design with an allowance that stands on the consideration of the thinning of the timepiece body has become possible. Further, by the tooth profiles of the fourth gear, the fifth pinion, the fifth gear, the gear of the cage lower plate, the escape pinion and the internal tooth gear having all been formed by an involute of the same module and the same pressure angle and also by the tooth profile of the driving gear that is meshed with the escape pinion when adjusting the time accuracy of the tourbillon mechanism having also been formed by the same involute, the adjustment of the time accuracy in the tourbillon mechanism that is made using the time accuracy adjusting jig has become more precise.

We claim:

1. A mechanical timepiece comprising: a tourbillon mechanism having a cage mounted for rotation and a timed annular balance, a pallet-fork and an escape wheel mounted in the cage for rotation therewith, the cage having an upper plate, a lower plate and a plurality of connecting members directly connecting the upper plate and the lower plate in spaced-apart relation, the lower plate having a gear on an outer periphery thereof; and a gear train having a train wheel connected to the gear of the lower plate of the cage for rotationally driving the cage.

2. A mechanical timepiece as set forth in claim 1; further comprising a base plate rotatably supporting the cage, an internal gear integrally connected to the base plate, and an escape pinion mounted coaxially with the escape wheel and in meshing engagement with the internal tooth gear; wherein when the cage is rotated, the escape pinion and the internal tooth gear undergo planetary movement and the escape wheel undergoes revolution while undergoing rotation about a rotating axis.

3. A mechanical timepiece as set forth in claim 1; wherein the timed annular balance has a rim portion and is pivotally supported by the upper and lower plates of the cage; and wherein the upper plate of the cage has a pallet bridge for pivotally supporting the pallet-fork, and the pallet bridge does not overlap the rim portion of the timed annular balance when both are viewed in the direction of a rotational axis of the cage.

4. A mechanical timepiece as set forth in claim 1; further comprising an escape pinion mounted coaxially with the escape wheel; and wherein at least the gear on the outer periphery of the cage lower plate, the internal tooth gear and the escape pinion have an involute tooth profile having the same module and the same pressure angle.

5. A mechanical timepiece as set forth in claim 1; wherein the lower plate of the cage has a hole for receiving a fastening element for fixing the cage during adjustment of the time accuracy of the mechanical timepiece.

6. A mechanical timepiece as set forth in claim 1; wherein each of the upper and lower plates of the cage has a pair of connecting holes, the connecting holes of the upper plate being disposed in aligned relation with respective connecting holes of the lower plate to define two pairs of aligned connecting holes, each pair of aligned connecting holes receiving respective end portions of one of the connecting members; and further comprising fastening means for fastening the upper plate or the lower plate to the connecting members.

7. A mechanical timepiece as set forth in claim 1; wherein the lower plate is formed from a single piece of material.

8. A mechanical timepiece comprising: a tourbillon mechanism having a housing mounted for rotation about a rotational axis, an escape wheel mounted in the housing for rotation, a balance wheel mounted in the housing for undergoing rotational vibration, and a pallet-fork for transmitting the rotational force of the escape wheel to the balance wheel, the housing having a first plate, a second plate and a plurality of connecting members for connecting the first and second plates in spaced-apart relation, the second plate having a gear formed on an outer peripheral surface thereof; and a drive train connected to the gear of the second plate for rotationally driving the housing.

9. A mechanical timepiece as set forth in claim 8; wherein the second plate is formed from a single piece of material.

10. A mechanical timepiece as set forth in claim 9; wherein each of the first and second plates of the housing comprises a pair of connecting holes, the connecting holes of the first plate being disposed in aligned relation with respective connecting holes of the second plate to define two pairs of aligned connecting holes, each pair of aligned connecting holes receiving respective end portions of one of the connecting members; and further comprising fastening means for fastening the first plate or the second plate to the connecting members.

11. A mechanical timepiece as set forth in claim 8; further comprising a base plate for rotatably supporting the housing, an internal tooth gear integrally connected to the base plate, and an escape pinion mounted coaxially with the escape wheel and in meshing engagement with the internal tooth gear; wherein when the housing is rotated, the escape pinion and the internal tooth gear undergo planetary movement and the escape wheel undergoes revolution while undergoing rotation.

12. A mechanical timepiece as set forth in claim 8; wherein the balance wheel has a rim portion and is pivotally supported by the first and second plates of the housing; and wherein the first plate of the housing has a pallet bridge for pivotally supporting the pallet-fork.

13. A mechanical timepiece as set forth in claim 12; wherein the pallet bridge does not overlap the rim portion of the balance wheel when the pallet bridge and the balance wheel are viewed in the direction of the rotational axis of the housing.

14. A mechanical timepiece as set forth in claim 8; further comprising an escape pinion mounted coaxially with the escape wheel; and wherein the gear formed on the outer peripheral surface of the second plate of the housing, the internal tooth gear and the escape pinion have an involute tooth profile having the same module and the same pressure angle.

15. A mechanical timepiece as set forth in claim 8; wherein the second plate of the housing has a hole for receiving a fastening element for fixing the housing during adjustment of the time accuracy of the mechanical timepiece.

16. A mechanical timepiece comprising: a tourbillon mechanism having a housing mounted for rotation about a rotational axis, a base plate for rotationally supporting the housing, an escape wheel mounted in the housing for rotation, an escape pinion mounted integrally and coaxially with the escape wheel, a balance wheel mounted in the housing for undergoing rotational vibration, a pallet-fork for transmitting the rotational force of the escape wheel to the balance wheel, and a pallet bridge for pivotally supporting the pallet-fork, the housing having a first plate, a second plate and a plurality of connecting members for connecting the first and second plates in spaced-apart relation, the second plate having a gear formed on an outer peripheral surface thereof; an internal tooth gear integrally connected to the base plate and in meshing engagement with the escape pinion so that when the housing is rotated, the escape pinion and the internal tooth gear undergo planetary movement and the escape wheel undergoes rotation and revolution; and a drive train connected to the gear of the second plate for rotationally driving the housing.

17. A mechanical timepiece as set forth in claim 16; wherein the balance wheel is pivotally supported by the first and second plates of the housing.

18. A mechanical timepiece as set forth in claim 16; wherein pallet bridge is mounted on the first plate of the housing.

19. A mechanical timepiece as set forth in claim 16; wherein the balance wheel has a circumferential rim portion; and wherein the pallet bridge does not overlap the circumferential rim portion of the balance wheel when the pallet bridge and the balance wheel are viewed in the direction of the rotational axis of the housing.

20. A mechanical timepiece as set forth in claim 16; wherein the gear formed on the outer peripheral surface of the second plate of the housing, the internal tooth gear and the escape pinion have an involute tooth profile having the same module and the same pressure angle.

* * * * *